United States Patent [19]

Rydborn

[11] Patent Number: 4,763,588

[45] Date of Patent: Aug. 16, 1988

[54] APPARATUS FOR THREAD MONITORING IN A SEWING MACHINE

[76] Inventor: Sten Å. Rydborn, Klöxhultsvägen 21, S-343 00 Elmhult, Sweden

[21] Appl. No.: 891,185

[22] PCT Filed: Nov. 27, 1985

[86] PCT No.: PCT/SE85/00491

§ 371 Date: Jul. 17, 1986

§ 102(e) Date: Jul. 17, 1986

[87] PCT Pub. No.: WO86/03233

PCT Pub. Date: Jun. 5, 1986

[30] Foreign Application Priority Data

Nov. 28, 1985 [SE] Sweden ..... 8406005

[51] Int. Cl.[4] ..... D05B 69/36

[52] U.S. Cl. ..... 112/273; 112/278

[58] Field of Search ..... 112/273, 278, 155; 139/273 R; 242/37 R

[56] References Cited

U.S. PATENT DOCUMENTS

| | | | |
|---|---|---|---|
| 3,783,811 | 1/1974 | Schmedding et al. | 112/273 X |
| 4,180,007 | 12/1979 | Peterson et al. | 112/278 |
| 4,372,235 | 2/1983 | Principe | 112/273 |

FOREIGN PATENT DOCUMENTS

| | | | |
|---|---|---|---|
| 0220064 | 3/1985 | German Democratic Rep. | 112/278 |

*Primary Examiner*—Peter Nerbun

*Attorney, Agent, or Firm*—Beveridge, DeGrandi & Weilacher

[57] ABSTRACT

An apparatus for monitoring one or more threads in a sewing machine with a number of sewing heads, the signal emitter including a spring arm (2) which is fixedly anchored at its one end (3) and, at its opposite end, carries a magnet (9), this opposite end being moreover located in the path of movement of the lower thread (12) in order to be influenced by same and thereby change the position of the magnet (9) in relation to an element (10) sensitive to the position of the magnet (9) and generating an electric signal in dependence upon the position of the magnet (9), the signal change being sensed and evaluated.

3 Claims, 11 Drawing Sheets

IC1 = 14584
IC2 = 4093
IC3 = 4017
IC4 = 4013
IC5 = 4013
IC6 = LM324
IC7 = 4520

| | |
|---|---|
| FIG. 10A | FIG. 10B |
| FIG. 10C | FIG. 10D |

APPARATUS FOR THREAD MONITORING IN A SEWING MACHINE

BACKGROUND OF THE INVENTION

The present invention relates to an apparatus for the monitoring of one or more threads in a sewing machine with a number of sewing heads for at least one upper thread and one lower thread and with at least one signal emitter for generating an electric signal in correspondence to the movement of the lower thread during a certain period of time.

Apparatus for the monitoring and sensing of the upper and lower threads in sewing machines with one, and in many cases several, sewing heads are exposed to relatively great mechanical stresses and have failed, as a result of shortcomings in strength and unreliability, to reach any desired degree of use. However, it is an extremely urgent demand in this art to be able to monitor the threads in order to attain as faultless seams and sewing as possible. The quicker the machines work, the greater is the need of being able to monitor the threads. Moreover, it is, in many cases desirable to be able to stop the machine automatically in the event of thread breakage. Hence, there is a great need within this art for a reliable and mechanically durable signal emitter.

The task of satisfying the above-outlined needs forms the basis of the present invention.

SUMMARY OF THE INVENTION

This task is solved according to the present invention in that the apparatus disclosed by way of introduction is characterized in that the signal emitter includes a spring arm which is fixedly anchored at one end and, at the opposite end, supports a magnet, that this opposite end is located in the path of movement of the lower thread, in order to be influenced by the lower thread in at least a certain movement thereof, that an element sensitive to the position of the magnet is disposed so as, in correspondence to the change of position of the magnet as a result of the movement of the lower thread, to generate the electric signal, and that the element is coupled to a signal evaluation circuit for indicating the loss of the signal during at least a certain period of time and possibly stopping of the sewing machine.

By means of an apparatus according to the present invention, there will be realized an extremely reliable and trustworthy monitoring of a desired movement of the lower thread in one or more sewing heads of a sewing machine. The apparatus according to the present invention has proved to satisfy stringent mechanical strength requirements and to display a great degree of reliability.

BRIEF DESCRIPTION OF THE DRAWINGS

The present invention will be described in greater detail below with reference to the accompanying Drawings.

DETAILED DESCRIPTION OF THE PREFERRED EMBODIMENT

Figure 1:
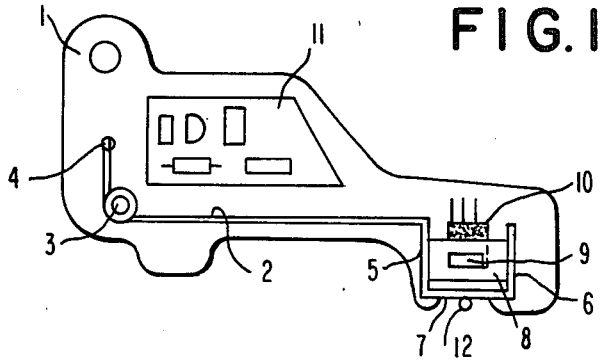
FIG. 1 is a schematic view of a signal emitter according to one embodiment of an apparatus according to the present invention.

The signal emitter shown in FIG. 1, according to one embodiment of the present invention, is built-up on a plate 1 which may suitably be cast in an appropriate plastic material. On the plate 1, there is fixedly disposed a spring thread arm 2 which is wound at least one turn about a pin 3 so that the arm 2 proper is pivotal about the pin 3. One end of the spring thread arm 2 is anchored in a hole 4 in the plate 1. The free end of the spring thread arm 2 is bent in U-shape so as to form two vertical prongs 5 and 6 and a web portion 7 or base prong uniting the vertical prongs. Between the vertical prongs 5 and 6, there is disposed a plate 8 which carries a magnet 9 which is located in the proximity of a generator element 10. The generator element 10 is, in the present embodiment, a Hall generator whose magnetic flux is influenceable by the magnet 9. When the magnet 9 is moved in relation to the generator 10, the magnetic flux in the circuit will be changed. In its turn, the change in the magnetic flux will result in a change of the output signal of generator 10, whereupon the changed output signal is amplified and evaluated. The generator 10 is coupled to an amplifier circuit 11 which is disposed on the plate 1. That thread 12 which is to be sensed is laid against the base prong 7 and, on tightening of the thread 12, the spring thread arm 2 will be bent in over the plate 1, which entails a change in the position of the magnet 9 and thereby a change in the magnetic flux in the generator 10.

Figure 2:
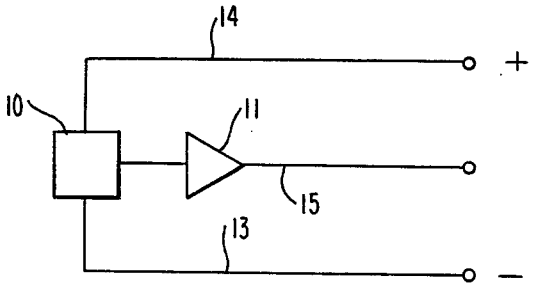
FIG. 2 is a diagram of the signal emitter of FIG. 1.
Figure 3:
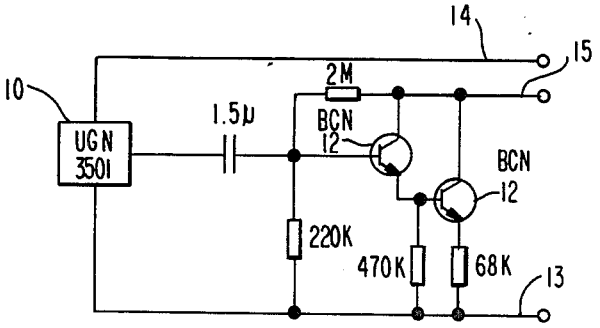
FIG. 3 shows the diagram of FIG. 2 in greater detail.

FIG. 2 illustrates a block diagram of the Hall generator 10 and its amplifier 11, it being apparent that the Hall generator is impressed with a supply voltage via two conductors 13 and 14, which results in a magnetic flux in the Hall generator 10, which in turn gives rise to an output signal which is amplified in the amplifier 11. On a change of the position of the magnet 9, the output signal from the generator 10 will be changed and the changed output signal will be amplified by means of the amplifier 11 and will subsequently be evaluated with the help of the circuit shown in FIG. 4. FIG. 3 shows a coupling diagram for the block diagram shown in FIG. 2, and the components included in the circuit have been given values and designations which have proved to be suitable on final testing of the signal emitter. The signal from the amplifier 11 occurs on a conductor 15.

Figure 4:
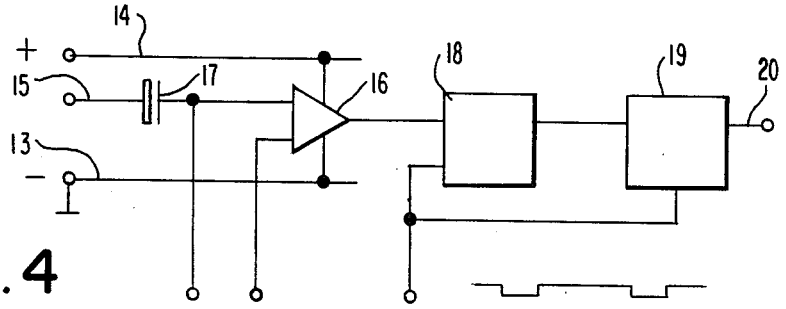
FIG. 4 is a diagram of a part of a signal evaluation circuit according to the present invention.

The signal on the conductor 15 is fed to the circuit illustrated in FIG. 4 and into its input 15. The signal is fed to a comparator 16 via a coupling capacitor 17. A sensitivity setting signal is fed to the second input of the comparator 16, this signal being variable and, when a large number of signal emitters are provided in one machine, the level of sensitivity can be centrally altered for all emitters. The signal on the input 15 must exceed the sensitivity setting signal in order that a signal be obtained on the output of the comparator 16. The signal obtained on the output of the comparator 16 is fed to a double flip-flop circuit 18 and 19. In the flip-flop circuit 18, 19, the signal is gated with a sensing signal. Using the sensing signal, that period of time when lower thread and upper thread move simultaneously is distinguished from that period of time when only lower threads are in motion and influence the signal emitter. The circuit illustrated in FIG. 4 may be considered as a signal evaluation circuit and is coupled to a central unit for sewing machines, the central unit being exemplified in FIGS. 9 and 10. The central unit is synchronised with the sewing machine so that a sensing pulse is obtained only during that period of time when solely the lower thread is to be in motion. Thus, on the output 20 from the flip-flops 18 and 19, there will be obtained a ready stop signal which can be used for indication and possible stopping of the sewing machine, if no signal is received from the comparator 16 during the sensing period.

Figure 5:
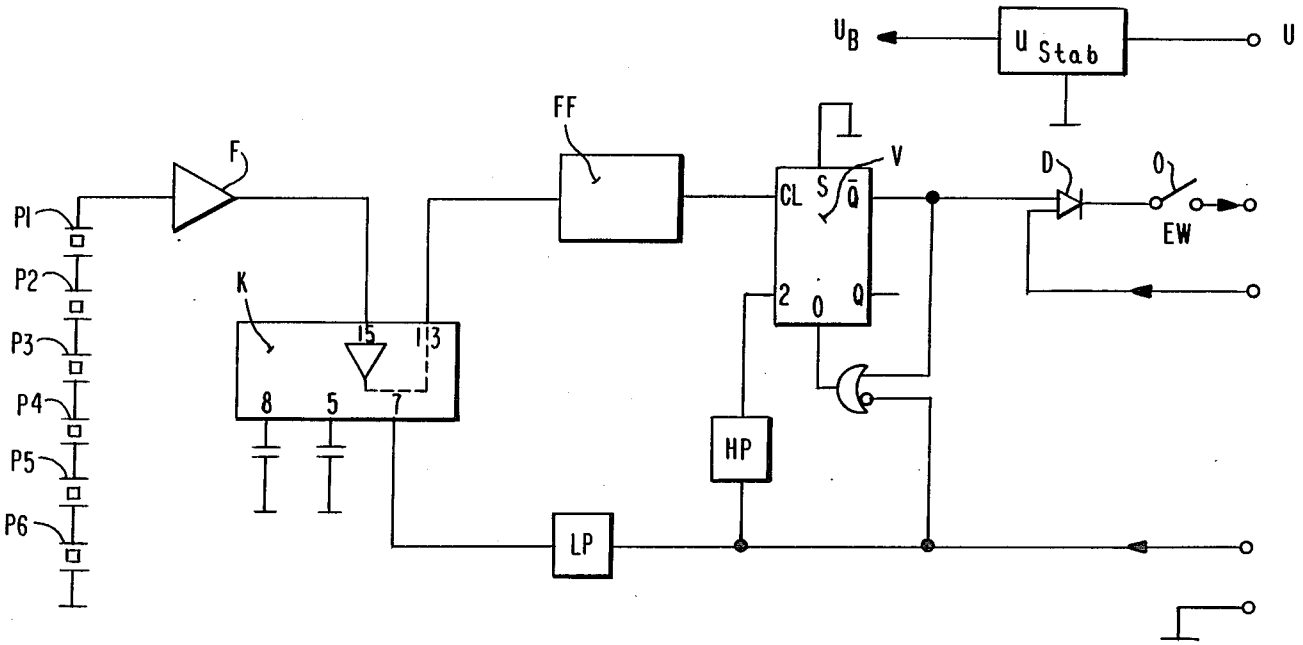
FIG. 5 is a block diagram of a circuit for the evaluation of thread monitoring signals from both the upper thread signal emitter and the lower thread signal emitter.

In many cases, a sewing machine is fitted with several sewing heads and it is desirable, therein, to monitor both the upper threads and the lower threads. FIG. 5 shows a block diagram of an upper thread monitoring unit. Therein, there is to be found a number of per se conventional piezoelectric emitters P1, P2, P3, P4, P5 and P6. The signal from the emitters P1–6 is fed via an amplifier F to a comparator K whose input 8 serves as a time-lag activation and whose input 5 serves as a time-lag deactivation, while the input 7 is a sensitivity signal input. The output signal from the comparator is fed to a flank-forming circuit FF whose output is coupled to a flip-flop circuit V, whose input R is coupled to a synchronisation pulse input and whose input D is coupled to a blocking pulse input and whose output Q is coupled to a two-coloured LED D, the red color input of the LED being coupled to the flip-flop V and the green coloured input to the output 20 of the circuit illustrated in FIG. 4. This means that on the occurrence of a stopping signal from any of the emitters P1–P6, the LED will show a red light, while showing a green light on the occurrence of a stopping signal from any one of the lower thread signal emitters. The signal from the LED D is fed via a switch O for feeding the signal to the central unit of the sewing machine. Thus, it is possible, using the switch O, to select only indication of stopping signals or the relaying of stopping signals to the central unit of the sewing machine for stopping thereof.

Figure 6:
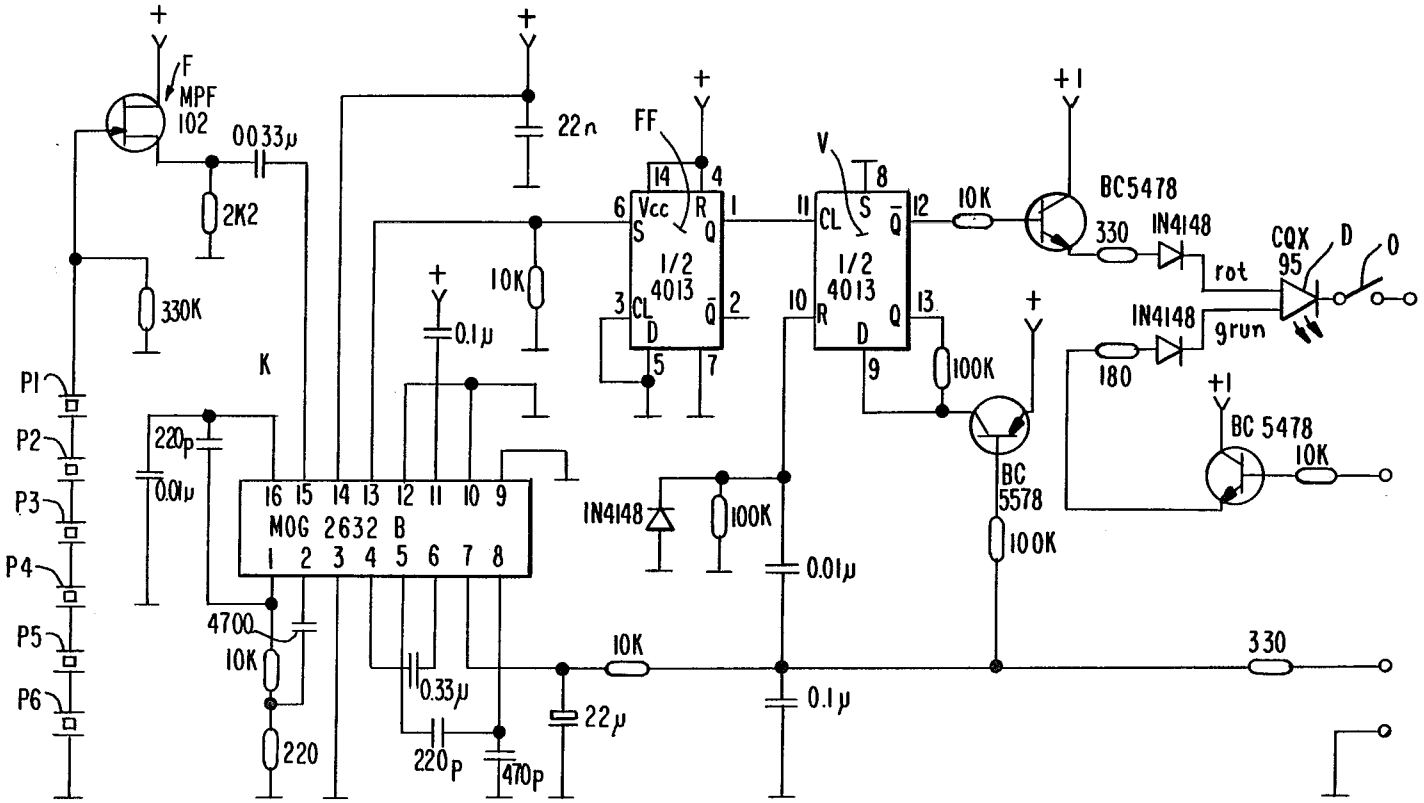
FIG. 6 is a coupling diagram for the circuit illustrated in FIG. 5.

FIG. 6 shows a coupling diagram for the circuit illustrated in FIG. 5, the circuit values being, naturally, disclosed by way of example.

Figure 7:
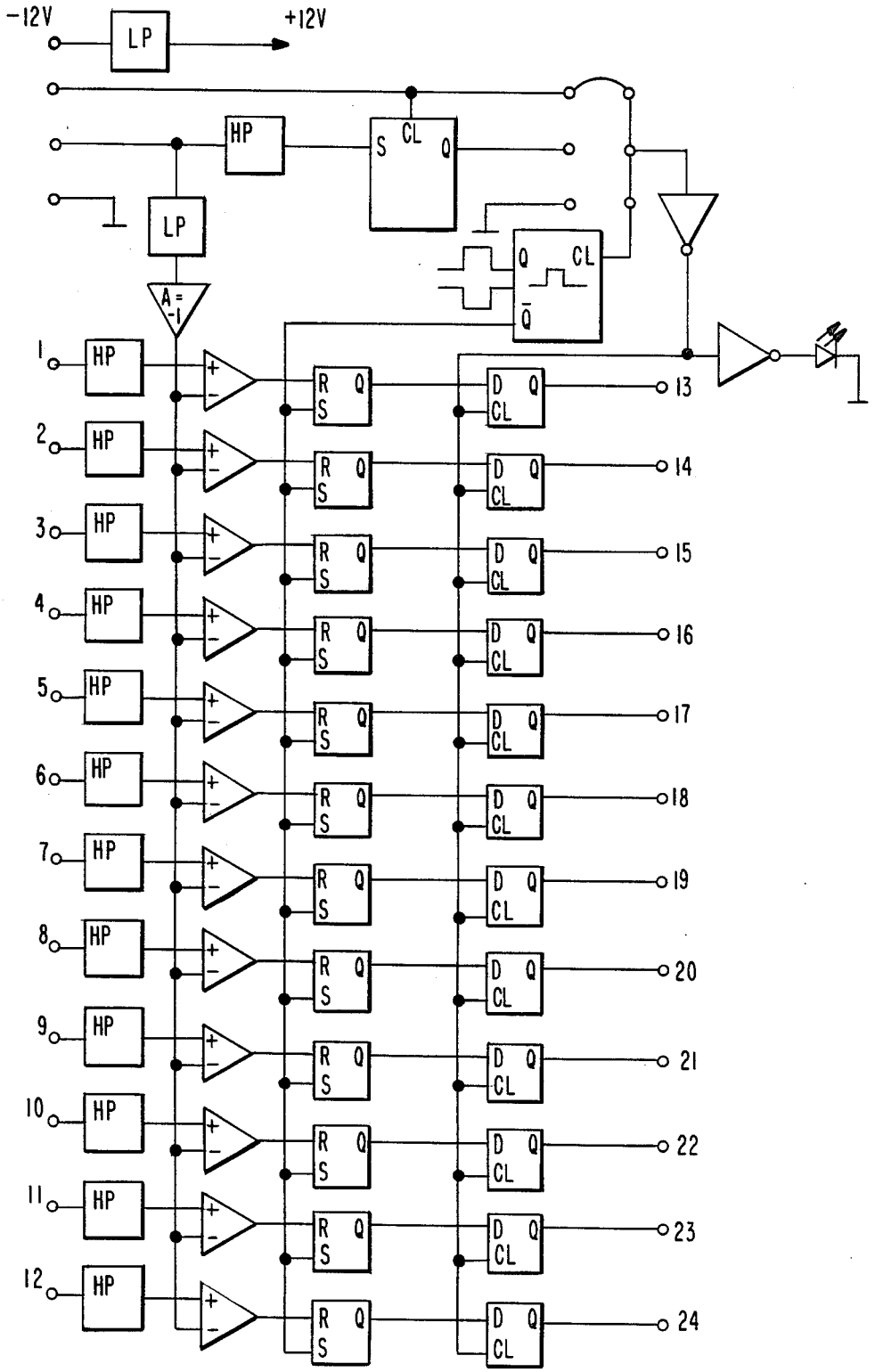
FIG. 7 is a block diagram of a circuit for the evaluation of thread monitoring signals from a number of lower thread signal emitters.
Figure 8A:
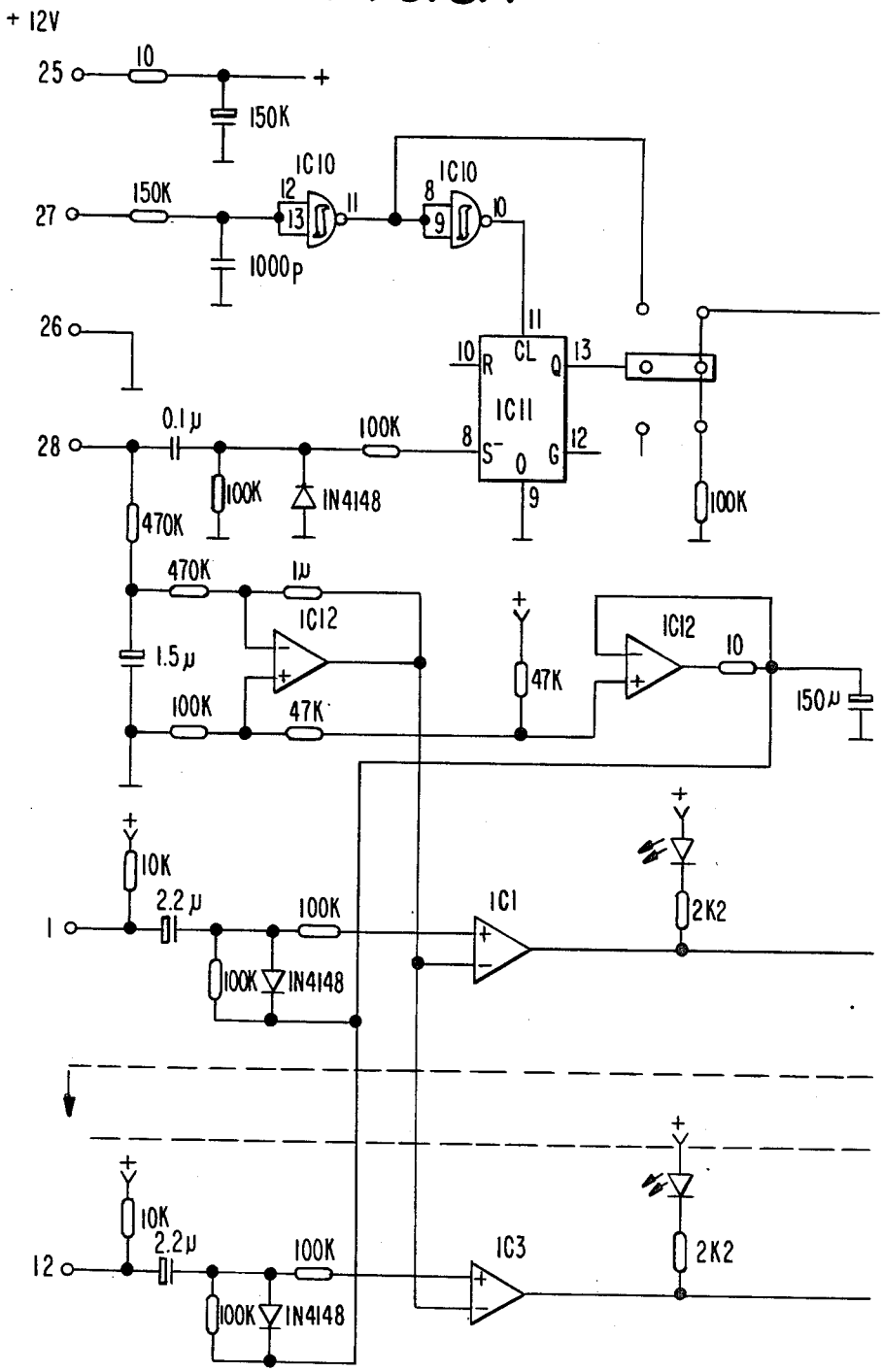
FIGS. 8*a*, 8*b* are a coupling diagram for the circuit illustrated in FIG. 7, a number of identical parts having been omitted.
Figures 8, 8B:
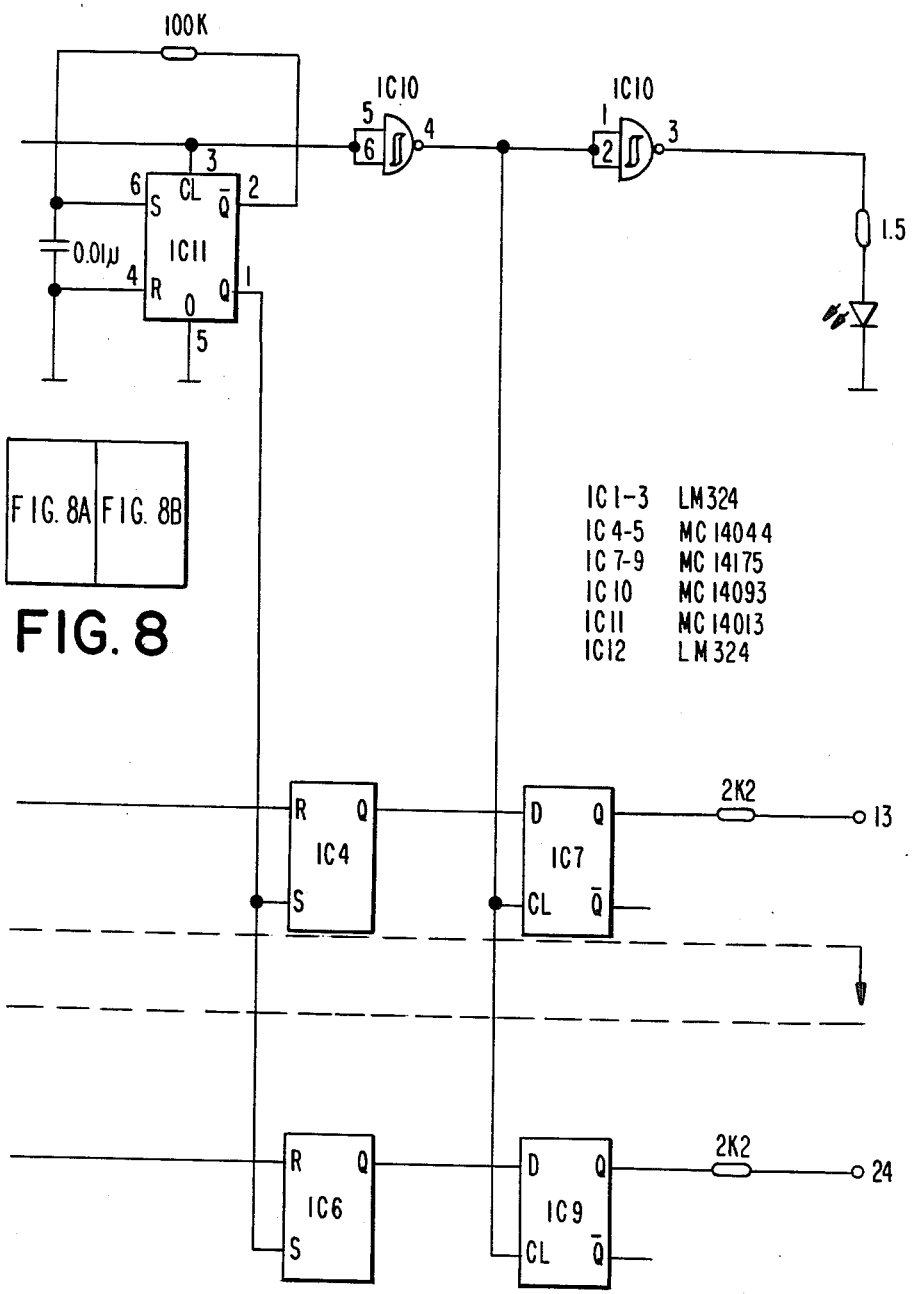

FIG. 7 shows a block diagram for an amplifier circuit for twelve lower thread signal emitters, each signal emitter 1–12 being coupled via the circuit illustrated in FIG. 4 to their output 13–24. The sensitivity setting inputs of the circuits are interconnected, like their sensing pulse inputs, the S inputs constituting the beginning of the sensing period and the CL inputs constituting the end of the sensing period. The HP circuits are high frequency filters, while the LP circuits are low frequency filters. FIG. 8 shows a coupling diagram for the block diagram shown in FIG. 7, although the circuit leads 2–11 have been omitted for purposes of clarity, and also since they are identical to the two illustrated circuits. It should be furthermore observed that the component values disclosed are merely by way of exemplification and may be amended without departing from the spirit and scope of the present invention.

Figure 9:
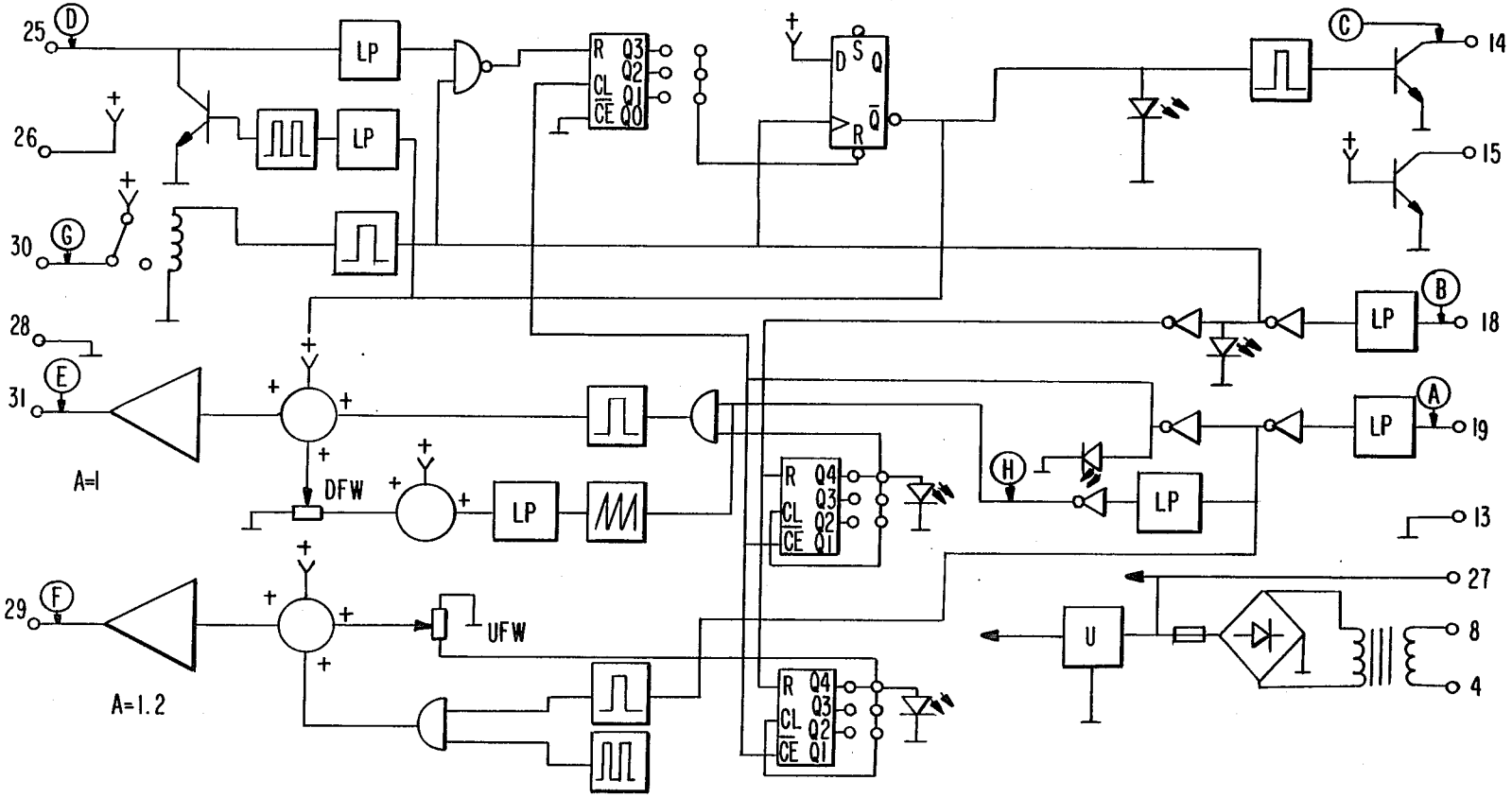
FIG. 9 is a block diagram for a central unit for a sewing machine
Figure 10A:
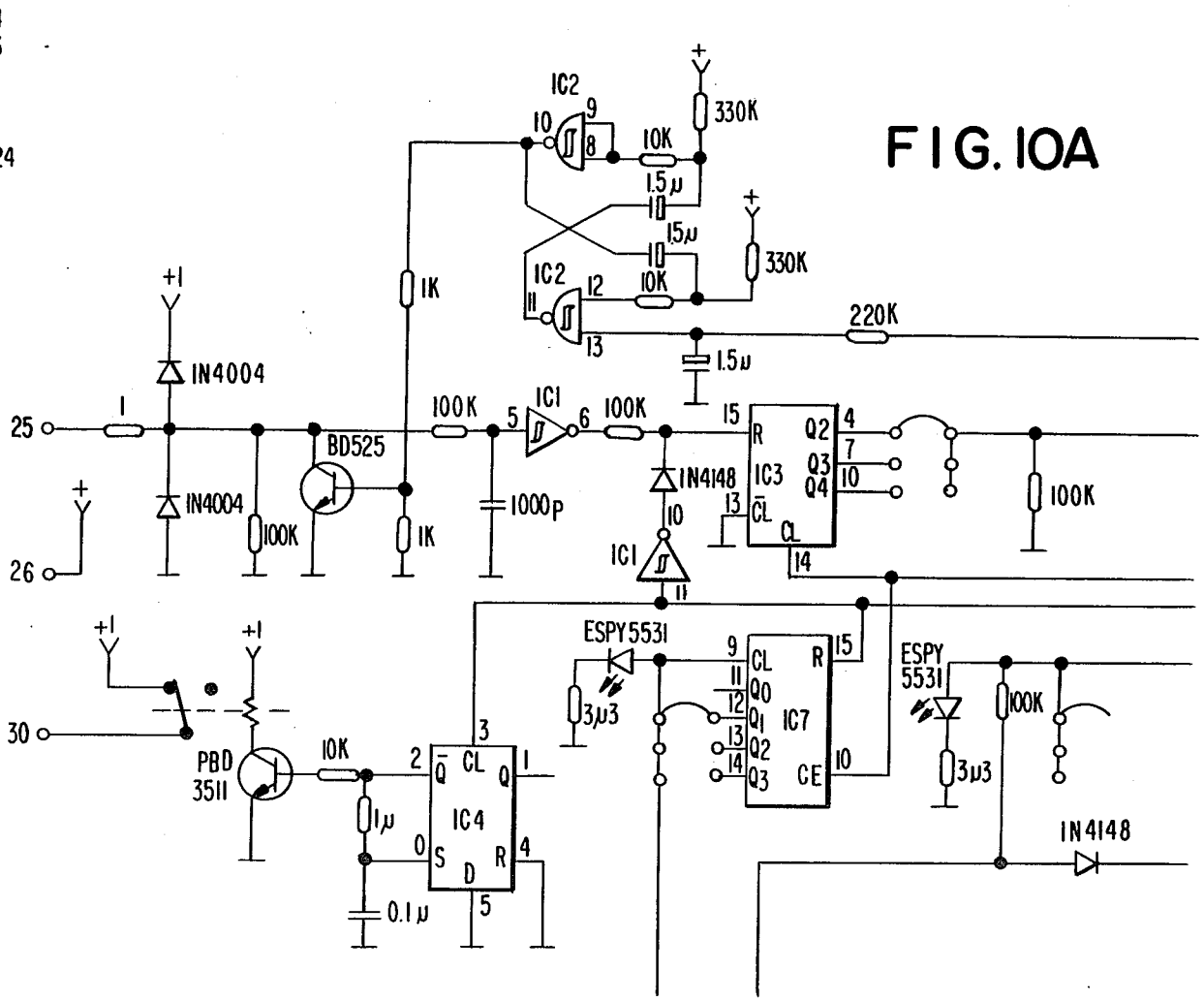
FIGS. 10A, 10B, 10C and 10D are a coupling diagram for the central unit shown in FIG. 9.
Figure 10B:
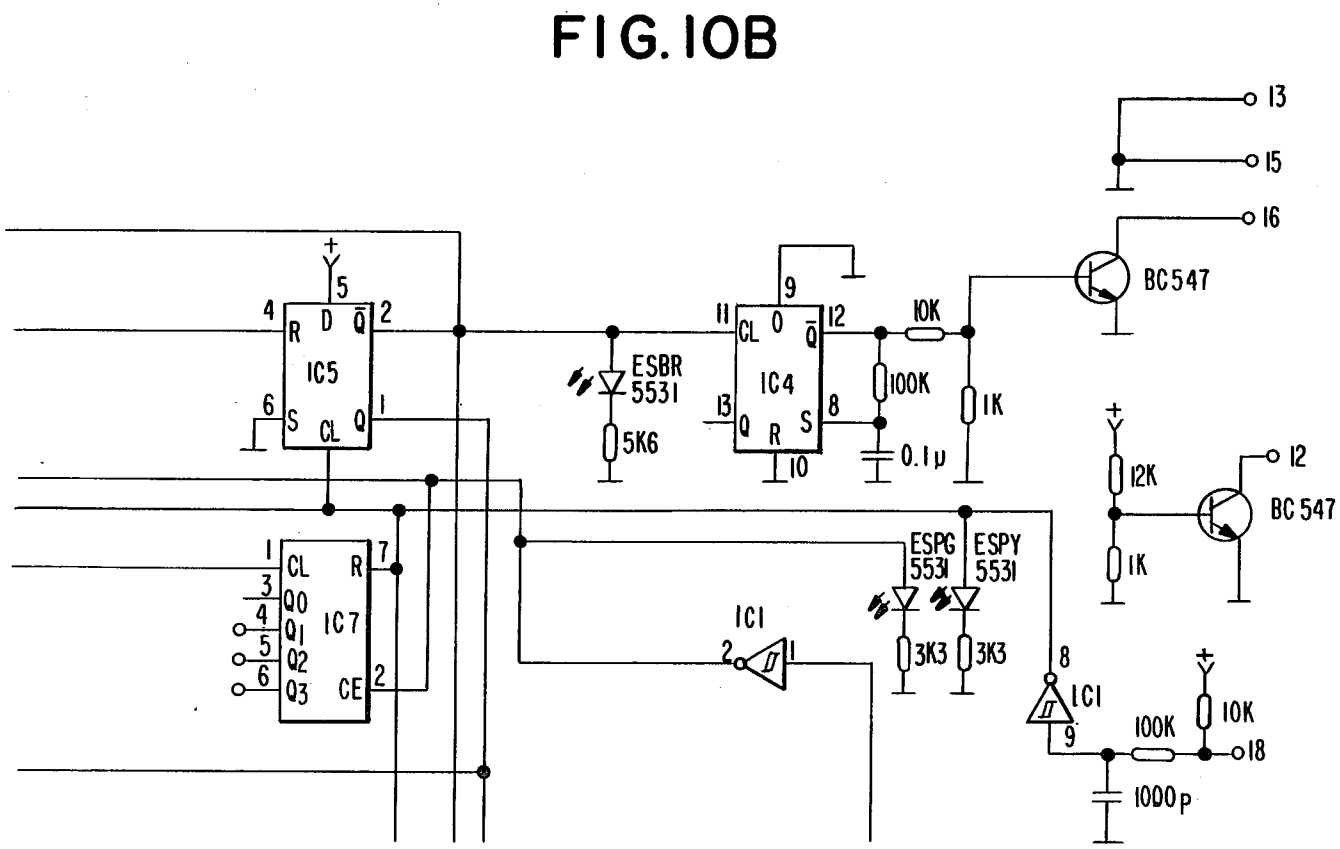
Figure 10C:
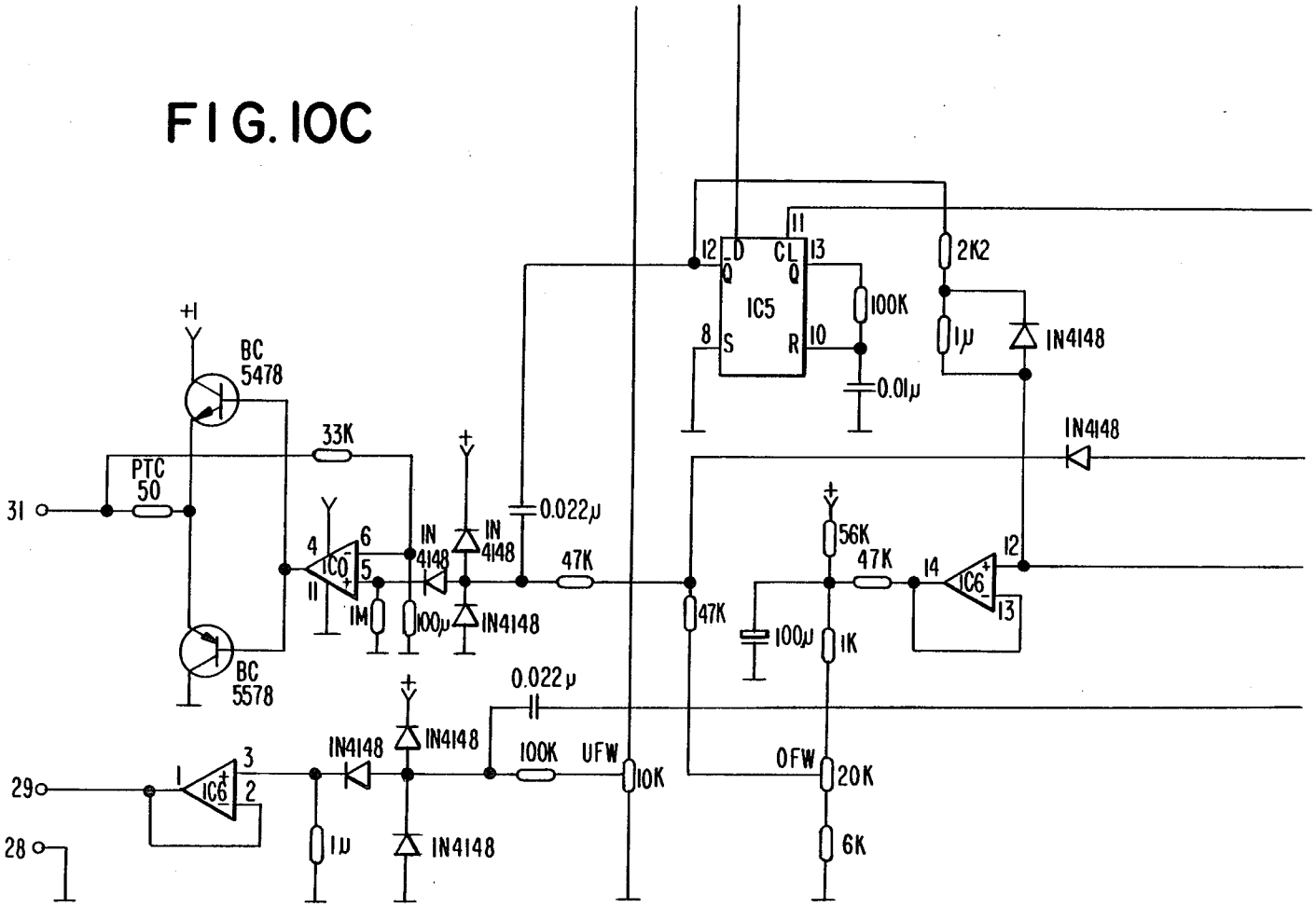
Figures 10, 10D:
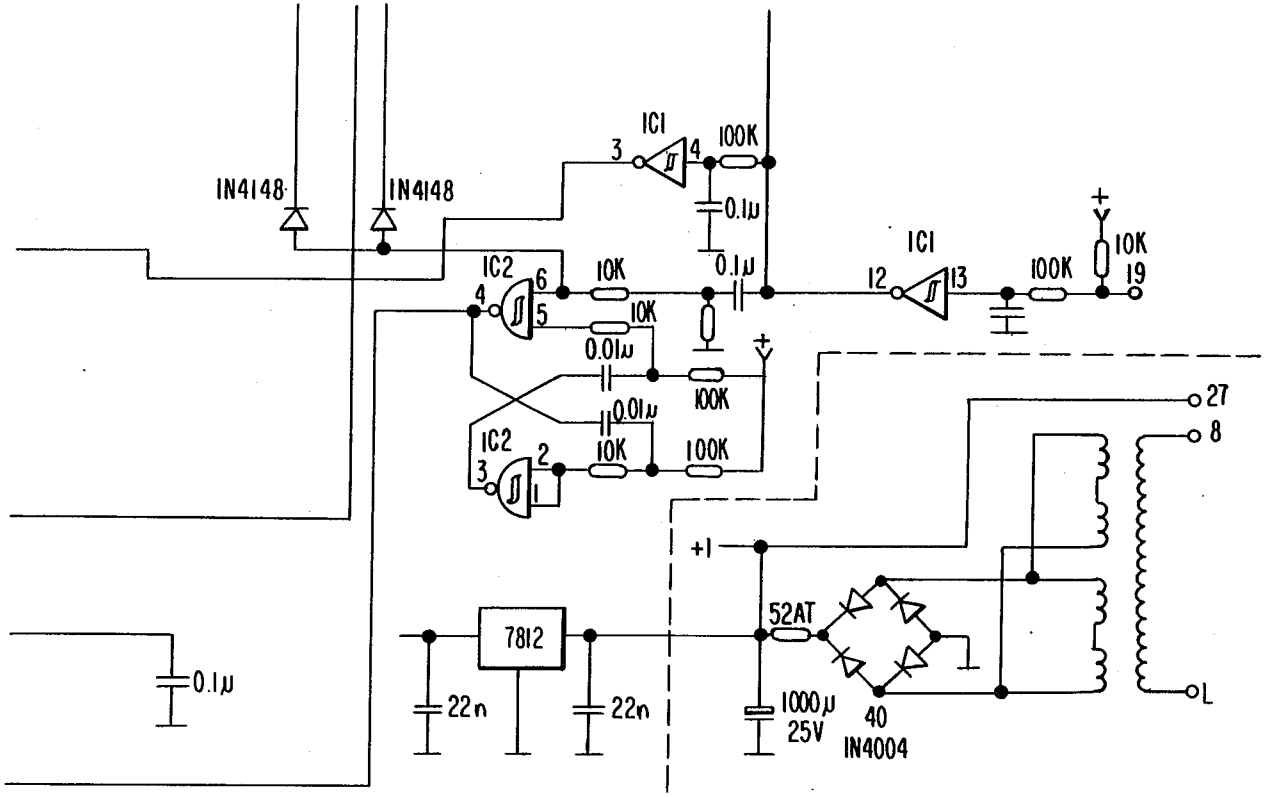

FIG. 9 shows a block diagram of a central unit according to the present invention and in FIG. 10 there is shown a coupling diagram for the central unit illustrated in FIG. 9, the component values disclosed therein being merely by way of exemplification and being variable without departing from the spirit and scope of the present invention. The sensitivity signal for the lower thread guards is fed to the connection 29 and the sensitivity signal for the upper thread guards is fed to the input 31. The upper thread guard signal is fed to the input 30 and the lower thread guard signal is fed to the input 26, while the stopping signal occurs on the input 25. It is possible to feed a stopping signal to the input 14, and an operational signal to the input 18, while the synchronization pulse is fed to the input 19. A supply voltage of 220 V is impressed onto the inputs 4 and 8.

I claim:

1. An apparatus for detecting the condition of a thread in a sewing machine comprising:

a signal emitter responsive to a magnetic field for generating an electrical signal indicative of the strength of the magnetic field;

a magnet;

a spring arm having a first end supporting said magnet and a second end;

anchoring means adapted to anchor said signal emitter and said spring arm second end on a sewing machine to position said spring arm first end and said magnet in a predetermined position with respect to said signal emitter, said spring arm normally biasing said first end and said magnet away from said signal emitter, with said spring arm adapted to be normally restrained by a tensioned thread of the sewing machine to retain said first end and said magnet in the predetermined position, whereby when said spring arm is restrained by the thread in the predetermined position, said signal emitter emits a first signal indicative of a normal thread condition and when said spring arm moves from the predetermined position said signal emitter emits a signal indicative of an abnormal thread condition; and a signal evaluation circuit connected to said signal emitter for indicating the signal from said signal emitter.

2. The apparatus according to claim 1, further comprising means for stopping the operation of the sewing machine when the signal evaluation circuit indicates a loss of the signal.

3. An apparatus as claimed in claim 1, wherein said spring arm is a thread spring, said first end of said spring arm comprising two prong portions and a web portion connecting said two prong portions to form a U-shaped end portion adapted to contact the thread, and said first end of said spring arm further comprising a support plate mounted on said web portion for supporting said magnet, said signal emitter being anchored adjacent a path of movement of said U-shaped portion and said magnet.

* * * * *